United States Patent [19]

Suzuki

[11] 3,975,894

[45] Aug. 24, 1976

[54] VIBRATION AND SOUND DAMPENING MEANS

[75] Inventor: Yoshihisa Suzuki, Nagoya, Japan

[73] Assignees: Toyoda Automatic Loom Works, Ltd., Kariya; Daiwa Spinning Co., Ltd., Osaka, both of Japan

[22] Filed: June 4, 1975

[21] Appl. No.: 583,738

Related U.S. Application Data

[63] Continuation of Ser. No. 428,228, Dec. 26, 1973, abandoned.

[30] Foreign Application Priority Data

Dec. 28, 1972 Japan ..... 47-481411

[52] U.S. Cl. ..... 57/58.89; 57/1 R; 248/358 R

[51] Int. Cl.[2] ..... D01H 1/12

[58] Field of Search ..... 57/1 R, 58.89–58.95, 57/34 R; 188/1 B, 1 C; 248/22, 358 R; 267/153; 74/574

[56] References Cited

UNITED STATES PATENTS

| | | | |
|---|---|---|---|
| 2,730,356 | 1/1956 | Hunter | 248/22 X |
| 3,026,224 | 3/1962 | Rogers | 248/22 X |
| 3,279,779 | 10/1966 | Thomas et al. | 267/153 |
| 3,311,331 | 3/1967 | Steimen | 248/22 |
| 3,436,042 | 4/1969 | Gourbergen | 248/358 R X |
| 3,511,045 | 5/1970 | Bures et al. | 57/58.91 |
| 3,595,002 | 7/1971 | Koritysky et al. | 57/58.89 |
| 3,643,414 | 2/1972 | Prochazka et al. | 57/58.95 X |
| 3,711,168 | 1/1973 | Wendel et al. | 57/58.89 UX |
| 3,760,577 | 9/1973 | Kihara et al. | 57/58.89 X |

FOREIGN PATENTS OR APPLICATIONS

| | | | |
|---|---|---|---|
| 1,153,821 | 10/1957 | France | 188/1 B |

*Primary Examiner*—John Petrakes
*Attorney, Agent, or Firm*—Frank J. Jordan

[57] ABSTRACT

A device for damping the vibrations and the vibrational force between a structural element in a vibrational state and a peripheral or adjacent element exposed to the vibrational force and the sound incidental to the vibration. In the device, a block-shaped means consisting of a vibration and sound-proof material has on at least one side thereof irregularities consisting of raised and depressed sections and this block-shaped means is interposed between the two elements so that the configuration consisting of the raised and depressed sections will dampen the vibrational force and the sound incidental thereto.

8 Claims, 9 Drawing Figures

VIBRATION AND SOUND DAMPENING MEANS

BACKGROUND OF THE INVENTION

In conventional machines having a rotary element rotating at high velocity, for example, an open-end spinning machine, a spindle rotating at high velocity tends to create and produce vibrations within itself mainly resulting from the rotary movement of the spindle itself and the beat of the drive-belt used for driving the spindle. The spindle's vibration, accompanied with the vibrational force of the bearings of the spindle, is carried or transmitted into the spindle's peripheral or surrounding or elements which generally causes the deterioration of the constructional strength of the peripheral or surrounding element and consequentially results in damages or to reducing the life of that element. Especially, in the case of the spinning body of an open-end spinning machine wherein a thread-breaks detector of delicate arrangement and construction is contained, the detector, when affected by oncoming vibration, tends to present or result in erroneous readings and operation. It is, therefore, an object of this invention to overcome the afore-mentioned disadvantages and to provide for dampening such vibration or vibrational forces.

Other features which are considered charateristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

SUMMARY OF THE INVENTION

The present invention relates to a means for damping the vibrations and the vibrational force between an element in a vibrational state and its peripheral or adjacent element which is exposed to vibrational force from that element and, at the same time, to dampen the incidental sound to vibration by means of interposing a specifically arranged block-shaped shaped means made of vibration and sound-proof materials between the two elements. The block-shaped means is arranged to have the configuration of irregularities consisting of raised and depressed sections in series on at least one side thereof so that the raised and depressed sections of the configuration will dampen the vibrations and the sound incidental to the vibration.

DETAILED DESCRIPTION OF THE INVENTION

Figure 1:
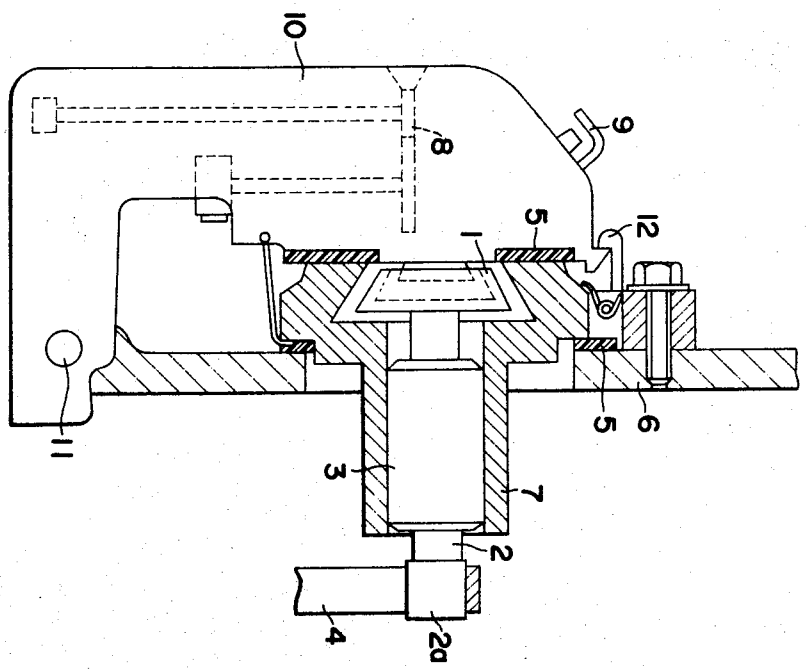
FIG. 1 is a partial sectional view of an open-end spinning machine showing an example of where the vibration and soundproof means of the present invention may be used.

Referring to the drawings FIG. 1 illustrates a widely known spindle-drive mechanism used in an open-end spinning machine. An embodiment of the present invention will be described as used in connection with the spindle-drive mechanism shown in FIG. 1.

In FIG. 1, a spindle 2 which originates or produces vibration is connected to a spinning rotor 1 at its one end and at the other end is secured to a pulley 2*a* having a drive-belt 4 running thereabout. The spindle 2 is rotably supported by bearings 3. The bearings 3 are mounted in a bearing support 7 which is secured to a yoke 6 through an interposed block-shaped element forming vibration and sound-proof means 5 constructed according to the present invention. In this construction and arrangement, the vibration of spindle 2, which is often accompanied by vibration of bearings 3, will not be carried or transmitted into the yoke 6, since the vibrational force from the spindle 2 will be absorbed or dampened by the interposed vibration and soundproof means 5. As is generally known, a housing or body 10 containing an opening portion 8 and a thread-breaks detector 9 or the like is pivotally supported by a pivot 11 and is secured to the yoke 6 and also to a hook 12 which constantly acts to close the openings of the spinning rotor 1 on the leftside end of the bearings support 7. Another vibration and soundproof means 5 is also interposed between the bearings support 7 and the housing or body 10.

Figure 2A:
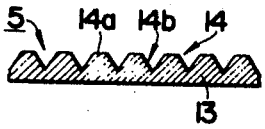
FIG. 2A is a partial sectional view of the vibration and sound-proof means according to one embodiment of the invention.
Figure 2B:
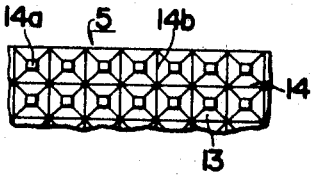
FIG. 2B is a plan view of the vibration and soundproof means shown in FIG. 2A.

The vibration and soundproof means 5, which is block-shaped, consists of two portions, that is a base portion 13 and a portion where the configuration of irregularities consisting of raised and depressed sections are formed in series as shown in FIG. 2. Each depression 14*b* naturally defines an air space 14. When the vibration and soundproof means 5 is interposed between the bearings support 7 and the yoke 6, the means 5 naturally comes into and remains at all times in contact with the vibrating bearings support 7, but only at the top portions of the raised sections 14a, so that the actual area of contact of the vibration and soundproof means 5 with the bearing support 7 is limited to a large extent. Furthermore, the interposed means 5, whenever exposed to the oncoming vibration from the bearings support, is subjected to deformation to a certain extent at its raised sections 14*a*. The limitation of the area of contact by the means 5 effectuates the damping of the oncoming vibrations from the bearings support 7, while the deformation at the raised portions 14*a* effectuates the absorption of the oncoming vibrations to dampen the vibrations. On the other hand, the depressed portions 14*b* which have spaces 14 which hold air therewithin naturally act as air cushions against the oncoming vibrational force from the bearings support 7, thereby promotes the vibration dampening effect to an appreciable extent. The sound damping effect to be produced by the interposed vibration and soundproof means 5 will be described referring to this first embodiment. Part of the vibration coming from the bearings support 7 is converted into sound at the depressed portions 14*b*, part of the sound wave is thrown or bounced back by the base 13 of the means 5, and the thrown-back sound waves interfere with each other and with the oncoming sound wave. This phenomenon results in producing a sound-damping effect.

Figure 3A:
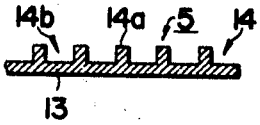
FIGS. 3A and 3B are partial sectional and plan views respectively of vibration and sound-proof means according to another embodiment of the invention.
Figure 3B:
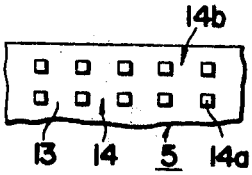
Figure 4A:
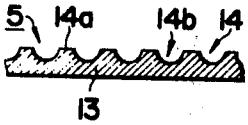
FIGS. 4A and 4B are partial sectional and plan views respectively of vibration and sound-proof means according to yet another alternate embodiment of the invention.
Figure 4B:
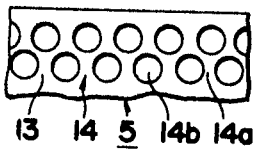

The arranging of the irregularities consisting of raised and depressed sections to define the vibration and sound-dampening means 5 may be made according to an alternate embodiment of the invention, by forming the raised section or projections in series as shown in FIGS. 3A and 3B. Thus, in these latter two figures, the raised sections 14*a* are defined by projections extending generally perpendicularly from the base 13 and being spaced from one another to define spaces 14*b* for air. In another alternate embodiment shown in FIGS. 4A and 4B, spaced raised sections 14*a* are defined by arcuate or curved side walls in that the depressions 14*b* are formed by semi-spherical surfaces.

Figure 5A:
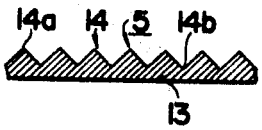
FIGS. 5A and 5B are partial and plan views respectively of vibration and soundproof means according to a further alternate embodiment of the invention.
Figure 5B:
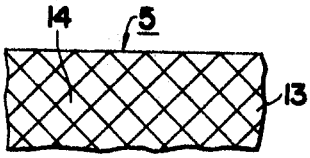

In yet a further alternate embodiment shown in FIGS. 5A and 5B, the raised sections 14*a* are formed by triangularly-shaped projections extending longitudinally and transversely of the base 13. Other alternate configurations may be utilized as desired.

Although in the illustrated embodiments the raised and depressed sections are shown on only one side of the base 13, such raised and depressed portions may be formed on both sides of the base.

This invention also is applicable to machines other than the aforementioned spinning machine and also may be used with various architectural structures for the purpose of dampening vibration and sound.

What is claimed is:

1. In an open-end spinning machine having means for dampening vibrations and sounds, the combination comprising a yoke on said spinning machine and having a front side and a back side, a body pivotally mounted on the front side of said yoke, said body having a thread-break detector mounted thereon, a rotating spindle, said yoke having a through opening, a bearing support for said rotating spindle passing through said opening in said yoke, said bearing support having a radial flange disposed on the front side of said yoke, said radial flange having an outer diameter greater than the diameter of said opening in said yoke to thereby provide a flat overlapping section of said radial flange relative to the portion of the front side of said yoke surrounding said opening in said yoke, vibration and sound-dampening material interposed in said flat overlapping section between said radial flange and the front side of said yoke, said spinning body having a radially disposed flat surface, said bearing support having a longitudinal flat end facing said radially disposed surface, and vibration and sound-dampening material interposed between said longitudinal flat end of said bearing support and said radially disposed flat surface of said spinning body, said vibration and sound-dampening material having a generally flat base and on at least one face thereof a plurality of raised and depressed portions, said raised portions contacting the adjacent or abutting surface at spaced locations while said depressed portions provide spaces therebetween, said spacec being disposed to effect an interference between the sound waves generated at said depressed portions and the sound waves bounced back from said base, whereby said vibration and sound-dampening material insulates the vibrations caused by the rotating spindle from said yoke, said pivotal body, and said thread-break detector to preclude erroneous readings of the latter without releasing of rotating sounds.

2. In an open-end spinning machine according to claim 1 wherein said depressed portions define air spaces operable to produce a sound-dampening effect.

3. In an open-end spinning machine according to claim 1 wherein said plurality of raised and depressed portions are formed on both sides of said base.

4. In an open-end spinning machine according to claim 1 wherein said plurality of raised portions are defined by frustrums of tetrahedons.

5. In an open-end spinning machine according to claim 1 wherein said plurality of raised portions are defined by tetrahedrons.

6. In an open-end spinning machine according to claim 1 wherein said raised portions are defined by spaced polyhedrons.

7. In an open-end spinning machine according to claim 1 wherein said raised portions have generally flat ends.

8. In an open-end spinning machine according to claim 1 wherein said raised portions have generally pointed ends.

* * * * *